US011161349B2

(12) United States Patent
Kumagai et al.

(10) Patent No.: US 11,161,349 B2
(45) Date of Patent: Nov. 2, 2021

(54) RECORDING APPARATUS

(71) Applicant: SEIKO EPSON CORPORATION, Tokyo (JP)

(72) Inventors: Katsunari Kumagai, Okaya (JP); Takayuki Yazawa, Shiojiri (JP); Norihide Hashimoto, Matsumoto (JP); Katsumi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/931,264

(22) Filed: May 13, 2020

(65) Prior Publication Data

US 2020/0361220 A1 Nov. 19, 2020

(30) Foreign Application Priority Data

May 15, 2019 (JP) ..... JP2019-091973

(51) Int. Cl.
*B41J 2/175* (2006.01)

(52) U.S. Cl.
CPC .. *B41J 2/17566* (2013.01); *B41J 2002/17573* (2013.01)

(58) Field of Classification Search
CPC ..... B41J 2002/17573
See application file for complete search history.

(56) References Cited

U.S. PATENT DOCUMENTS 5,684,516 A * 11/1997 Cseledy ..... B41J 2/16526 347/104
2002/0175979 A1 11/2002 Morita et al.
2003/0128256 A1* 7/2003 Oda ..... B41J 2/17513 347/85
2008/0129804 A1* 6/2008 Fukushima ..... B41J 2/17566 347/86
2018/0345678 A1* 12/2018 Koase ..... B41J 2/17513
2019/0152223 A1* 5/2019 Hirasawa ..... B41J 2/16511

FOREIGN PATENT DOCUMENTS

JP 2000108371 A * 4/2000
JP 2000-127432 5/2000
JP 2000289230 A * 10/2000

OTHER PUBLICATIONS

Machine generated, English translation of JP2000289230A to Kitajima, "Capturing Unit for Recorder"; retreived via worldwide.espacenet.com on Jul. 12, 2021; 10pp.*
Machine generated, English translation of JP2000108371A to Noda, "Inkjet Recording Apparatus"; retreived via worldwide.espacenet.com on Jul. 12, 2021; 7pp.*

* cited by examiner

*Primary Examiner* — Shelby L Fidler
(74) *Attorney, Agent, or Firm* — Workman Nydegger

(57) ABSTRACT

A recording apparatus includes a carriage having a recording head and an ink tank that stores ink to be supplied to the recording head, which are mounted on the carriage, wherein the ink tank has an inlet port provided in an upper part of the ink tank, and a prism provided in a lower part of the ink tank, the recording apparatus includes a sensor located under the carriage and having a light-emitting portion that emits light toward the prism and a light-receiving portion that receives light reflected by the prism, and, when the carriage is located at an ink replenishment position where the ink in the ink tank is replenished via the inlet port, the sensor is disposed at a position hidden by the carriage in plan view of the carriage as viewed from above the carriage.

18 Claims, 14 Drawing Sheets

RECORDING APPARATUS

The present application is based on, and claims priority from JP Application Serial Number 2019-091973, filed May 15, 2019, the disclosure of which is hereby incorporated by reference herein in its entirety.

BACKGROUND

1. Technical Field

The present disclosure relates to recording apparatuses.

2. Related Art

JP-A-2000-127432 discloses a recording apparatus that includes a liquid storage container mounted on a carriage and having a prism, and an optical unit mounted under the carriage and configured to emit light toward the prism and receive light reflected by the prism.

In the above recording apparatus, the installation position of the optical unit under the carriage is not clear. Therefore, for example, in replenishment of ink in the liquid storage container by using a replenishment container such as an ink bottle that stores ink, when ink is unintentionally spilled from the replenishment container, there is a problem that ink runs downward along the carriage and the dripped ink adheres to the optical unit, which causes deterioration in function of the optical unit.

SUMMARY

A recording apparatus of the present disclosure includes a carriage having a recording head that performs recording onto a transported medium and an ink tank that stores ink to be supplied to the recording head, which are mounted on the carriage, the carriage being configured to scan in a main scan direction, which is a direction intersecting a transport direction in which the medium is transported, wherein the ink tank has an inlet port provided in an upper part of the ink tank for replenishment of the ink, and a prism provided in a lower part of the ink tank, the recording apparatus includes a sensor located under the carriage and having a light-emitting portion that emits light toward the prism and a light-receiving portion that receives light reflected by the prism, and, when the carriage is located at an ink replenishment position where the ink in the ink tank is replenished via the inlet port, the sensor is disposed at a position hidden by the carriage in plan view of the carriage as viewed from above the carriage.

In the above recording apparatus, a frame extending in the main scan direction may be provided at a position under the carriage, and the sensor may be provided on the frame.

In the above recording apparatus, the sensor may be provided at a position deviated from a center of the frame in the main scan direction.

In the above recording apparatus, the sensor may be disposed at a position where a speed of the carriage scanning in the main scan direction is constant.

In the above recording apparatus, a top of the sensor may be located above a top surface of the frame.

In the above recording apparatus, a protruding portion that protrudes toward the frame may be disposed in a lower part of the carriage, and an abutting portion configured to abut against the protruding portion may be provided at a position facing the protruding portion on the frame.

In the above recording apparatus, a front panel may be provided in front of the carriage, and a notch may be formed in the front panel at a position corresponding to the carriage when the carriage is located at the ink replenishment position so that the ink tank is exposed through the notch.

A recording apparatus of the present disclosure includes a carriage having a recording head that performs recording onto a transported medium and an ink tank that stores ink to be supplied to the recording head, which are mounted on the carriage, the carriage being configured to scan in a main scan direction, which is a direction intersecting a transport direction in which the medium is transported, wherein the ink tank has an inlet port provided in an upper part of the ink tank for replenishment of the ink, and a prism provided in a lower part of the ink tank, the recording apparatus includes a sensor located under the carriage and having a light-emitting portion that emits light toward the prism and a light-receiving portion that receives light reflected by the prism, and an eaves is provided above the sensor such that the sensor is hidden by the eaves when the eaves is viewed in plan view from above the eaves.

DESCRIPTION OF EXEMPLARY EMBODIMENTS

1. First Embodiment

Figure 1:
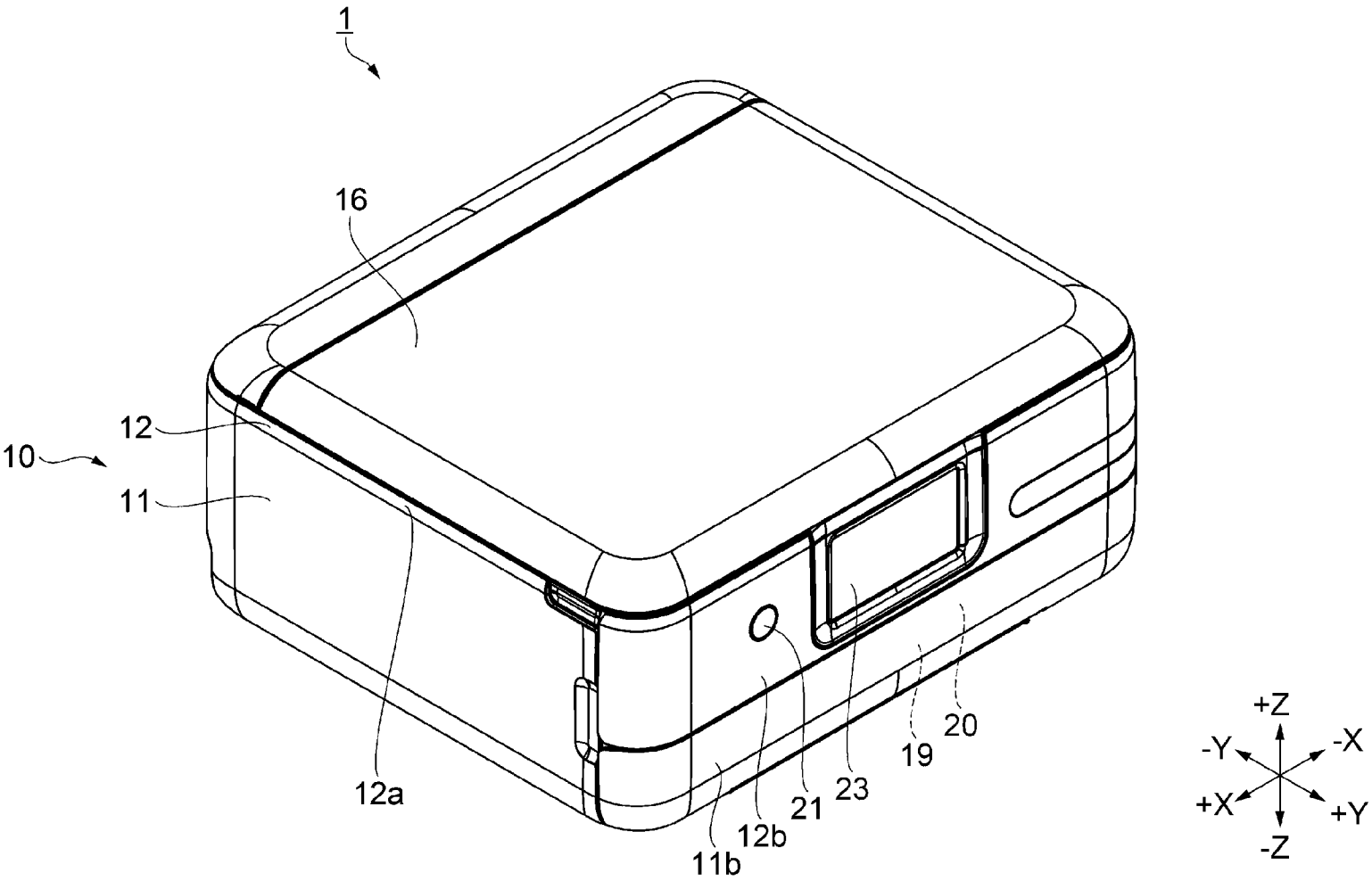
FIG. 1 is a perspective view illustrating a configuration of a recording apparatus according to a first embodiment.
Figure 2:
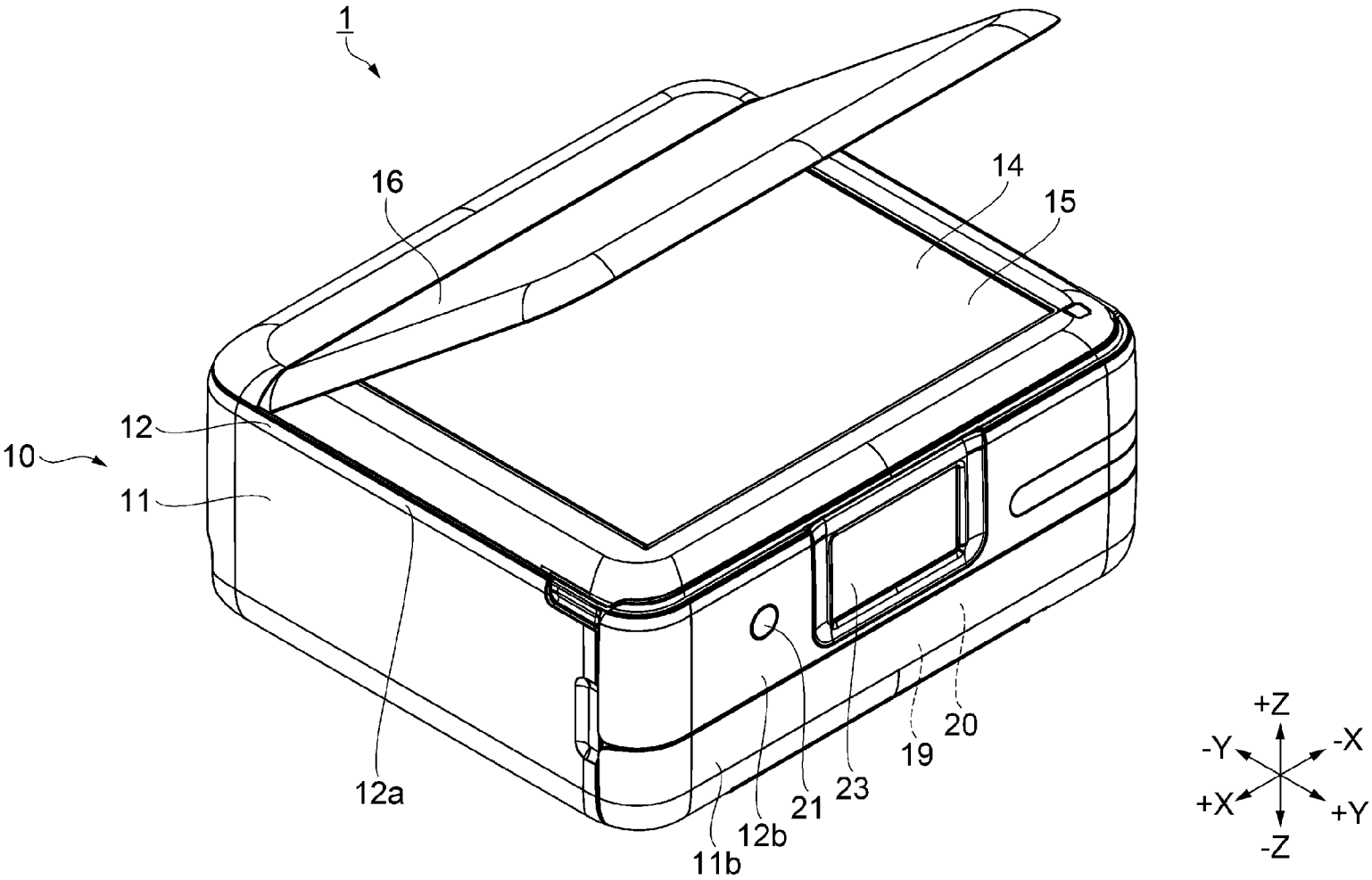
FIG. 2 is a perspective view illustrating a configuration of a recording apparatus according to the first embodiment.
Figure 3:
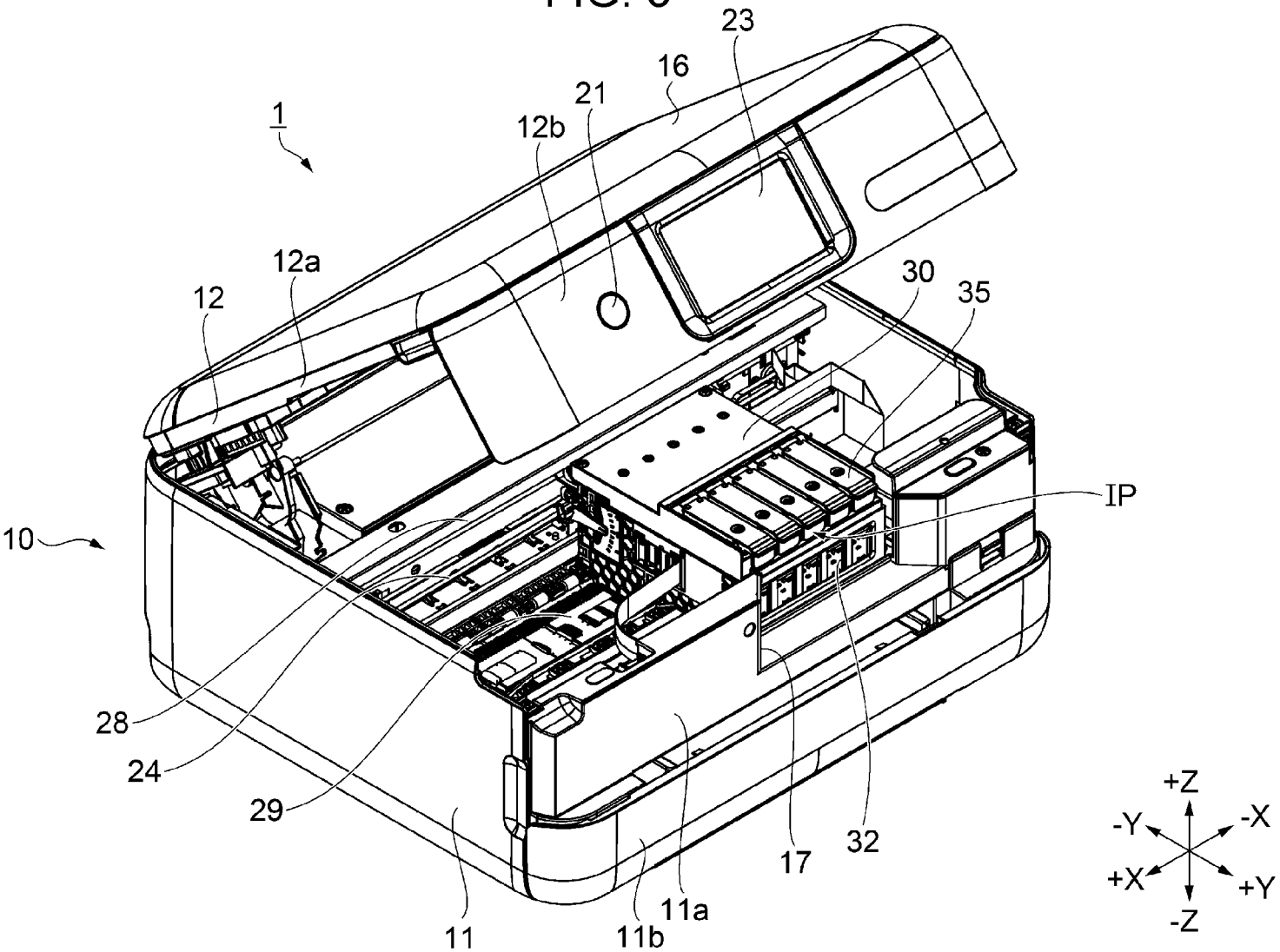
FIG. 3 is a perspective view illustrating a configuration of a recording apparatus according to the first embodiment.
Figure 4:
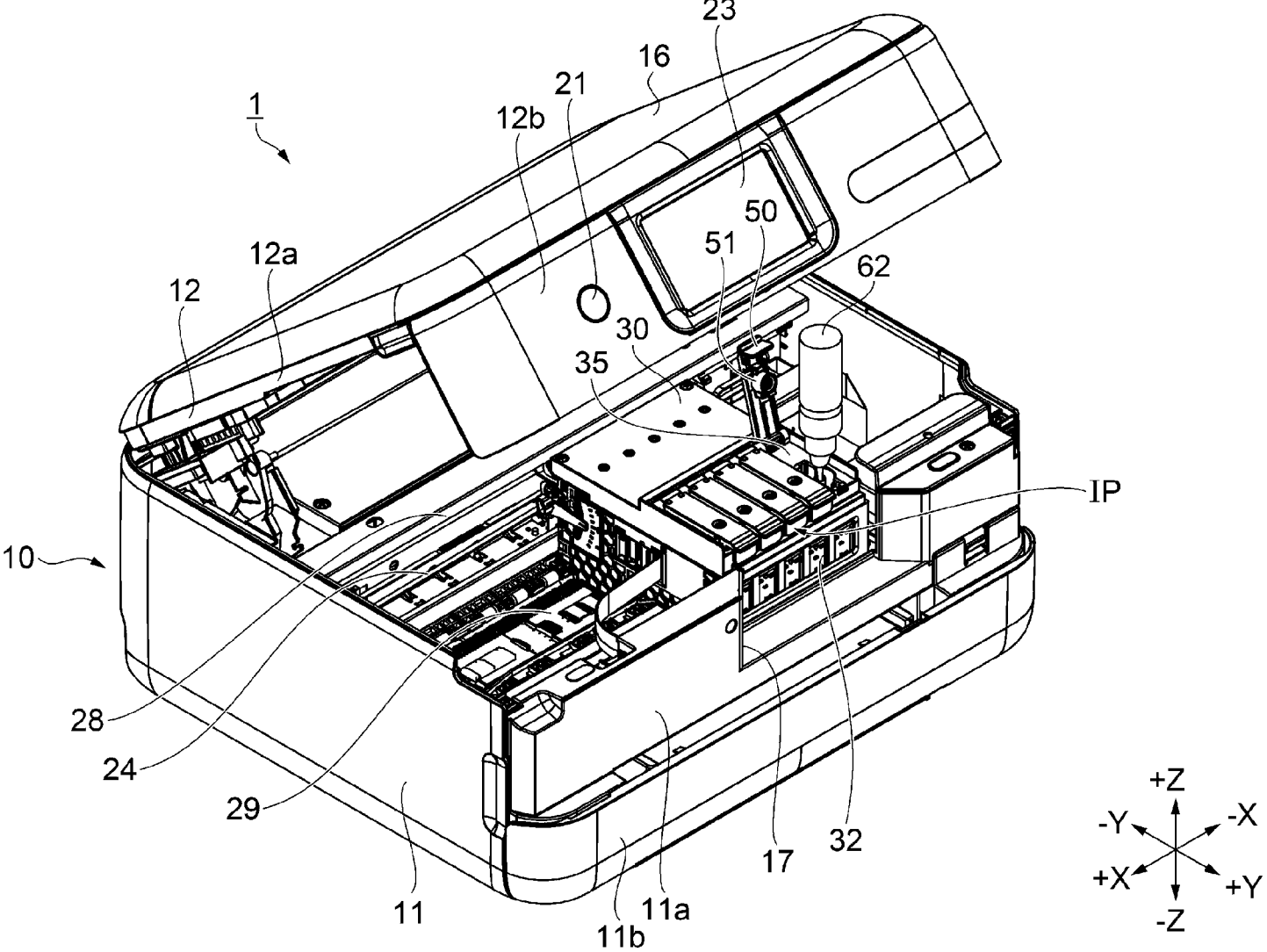
FIG. 4 is a perspective view illustrating a configuration of a recording apparatus according to the first embodiment.
Figure 5:
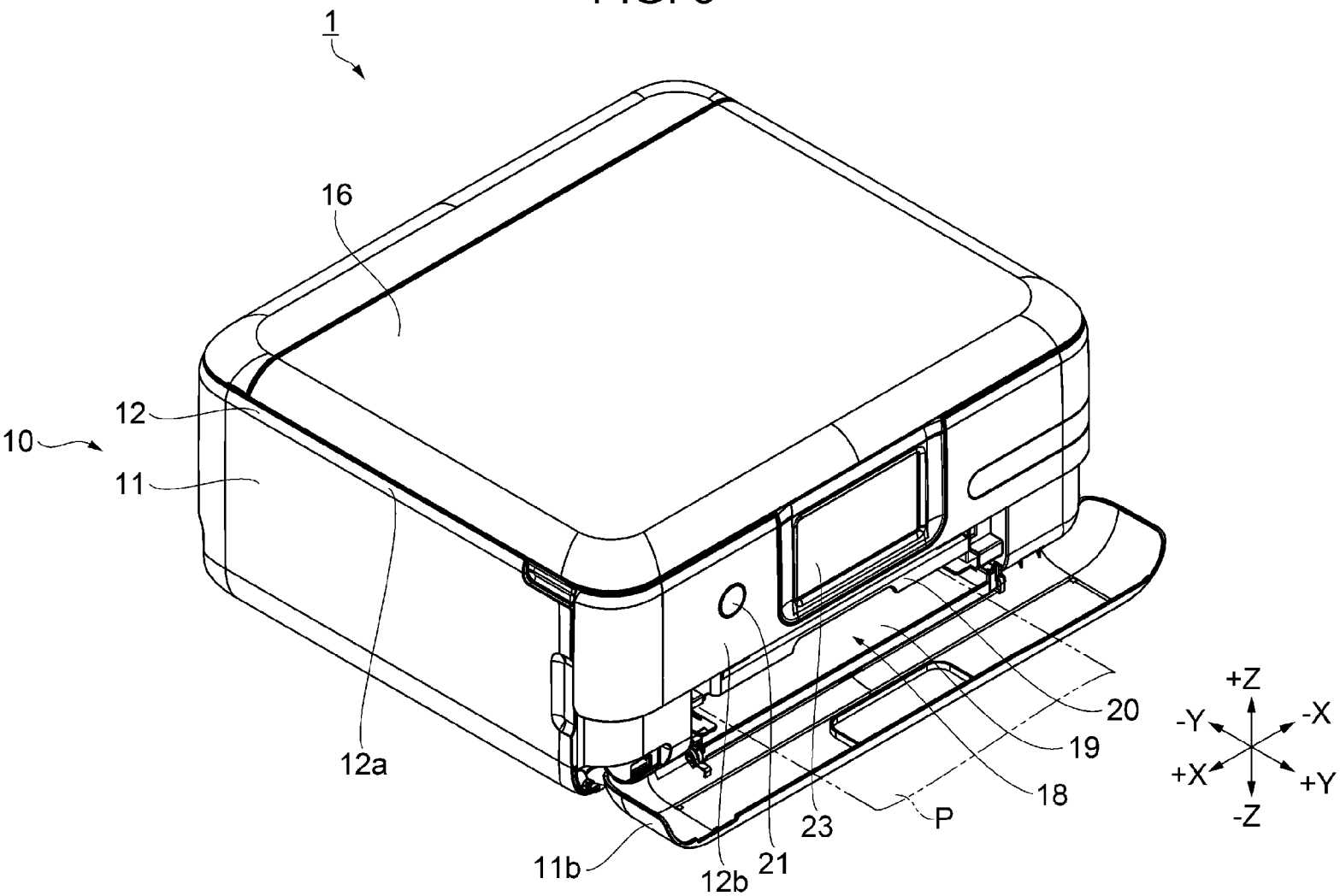
FIG. 5 is a perspective view illustrating a configuration of a recording apparatus according to the first embodiment.

FIGS. 1 to 5 are perspective views illustrating a configuration of a recording apparatus 1. Specifically, FIG. 1 illustrates an overall appearance of the recording apparatus 1, FIG. 2 illustrates that a document cover 16 of the recording apparatus 1 is open, and FIG. 3 illustrates that a top panel 12 of the recording apparatus 1 is open. FIG. 4 illustrates that ink is being replenished. FIG. 5 illustrates that a front openable panel 11*b* of the recording apparatus 1 is open. The recording apparatus 1 is an ink jet printer that performs recording by ejecting ink, which is an example of liquid, onto a paper sheet P, which is an example of a medium.

As shown in FIGS. 1 and 2, the recording apparatus 1 includes an apparatus main body 10. The apparatus main body 10 includes a housing 11 of a substantially cuboid shape, and a top panel 12 disposed on the housing 11. A document reading unit 14 and a document cover 16 are provided on the top panel 12. The document reading unit 14 includes a horizontal document placement surface 15 made of a transparent glass or the like on which a document to be read is placed, and the document cover 16 is configured to cover the document placement surface 15. The document cover 16 is pivotable about a rotation axis extending in the X axis so as to move between a closed state in which it covers the document placement surface 15 from above, and an open state in which it opens from the closed state to expose the upper side of the document placement surface 15.

As shown in FIG. 3, the top panel 12 is pivotable about a rotation axis extending in the X axis so as to move between a closed state in which it covers the upper side of the housing 11, and an open state in which it opens from the closed state to expose the upper side of the housing 11. When the top panel 12 is open, a user can access the inside of the housing 11 for maintenance or the like. Further, as shown in FIG. 4, ink in the ink tank 35 can be replenished by using a container such as an ink replenishing container 62 in which ink is stored.

The top panel 12 includes a first panel section 12*a* that covers the upper side of the housing 11, and a second panel section 12*b* that is bent downward from a +Y direction end of the first panel section 12*a* to cover a front panel 11*a* provided on a +Y direction side of the housing 11. The second panel section 12*b* is provided with a power supply button 21, which is operated for turning on and off the recording apparatus 1, and a touch panel 23 capable of displaying an input of operation and an operation state of the recording apparatus 1.

A front openable panel 11*b* is provided in the lower part of the front face of the housing 11, which is located on the +Y direction side. The front openable panel 11*b* is movable between a closed state in which it is held on the housing 11, and an open state in which it opens from the closed state to expose the housing 11. A shown in FIG. 5, when the front openable panel 11*b* is in the open state, an output port 18 is provided so that the paper sheet P is outputted therethrough from the apparatus main body 10. In the output port 18, a stacker 19 for supporting the paper sheet P placed thereon to be outputted from the housing 11 toward the output port 18 is provided. The stacker 19 is configured to be pulled out in the +Y direction. A paper sheet cassette 20 is provided in the housing 11. The paper sheet cassette 20 accommodates the paper sheets P to be printed in a stacked state. The paper sheet cassette 20 is detachably mounted to the apparatus main body 10.

Figure 6:
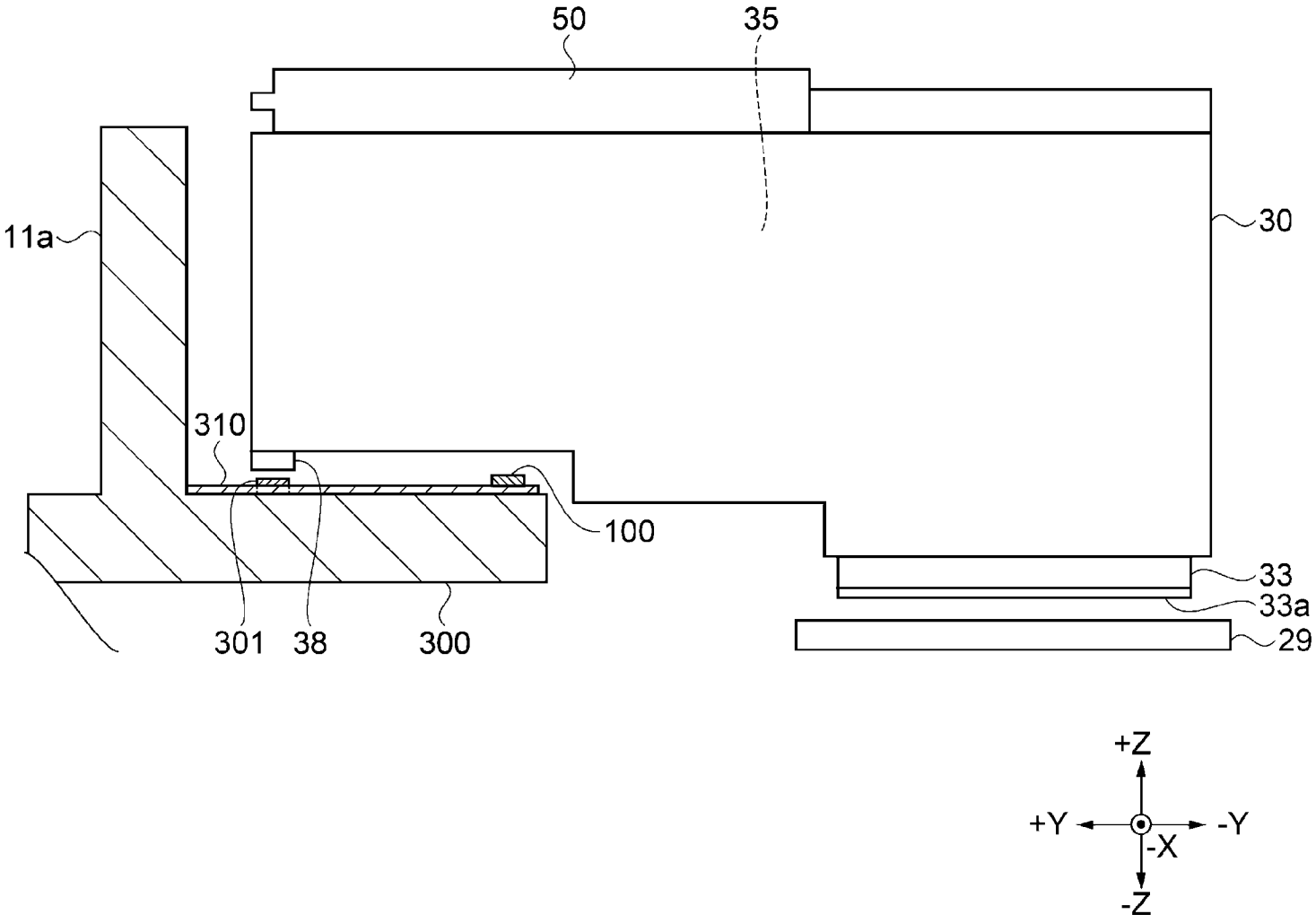
FIG. 6 is a side view illustrating a partial configuration of a recording apparatus according to the first embodiment.
Figure 7:
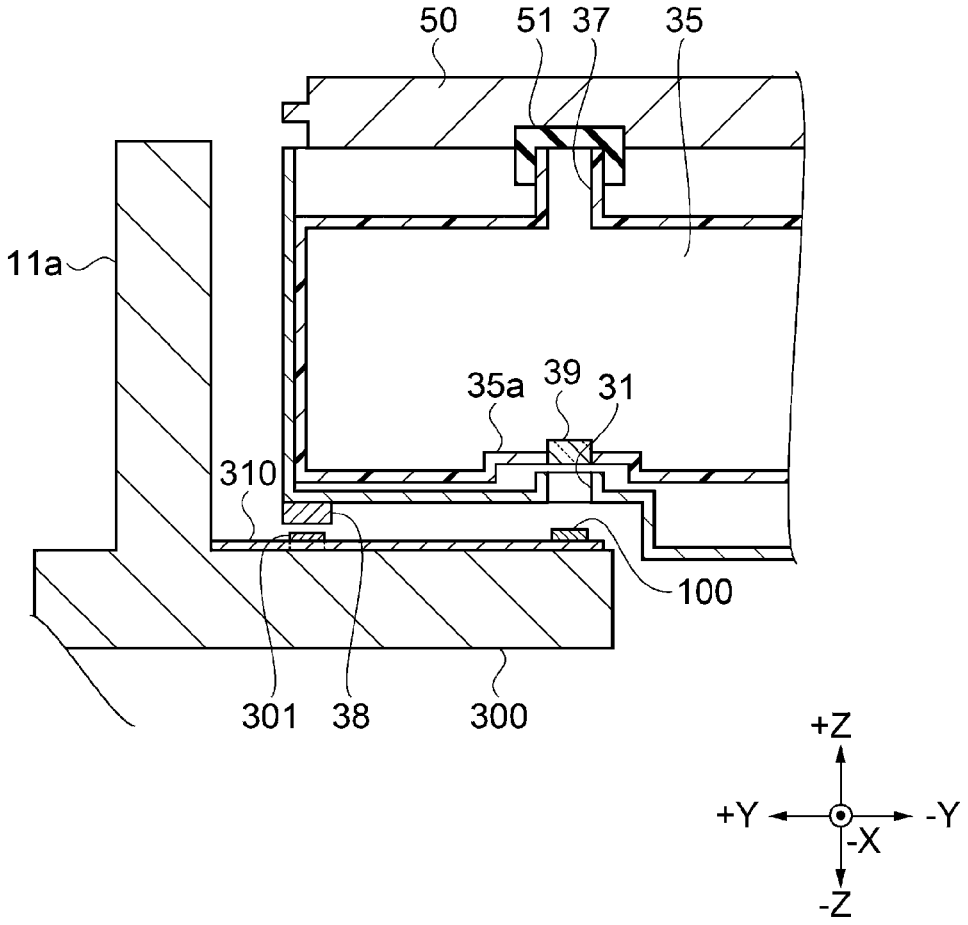
FIG. 7 is a side cross-sectional view illustrating a partial configuration of a recording apparatus according to the first embodiment.
Figure 8:
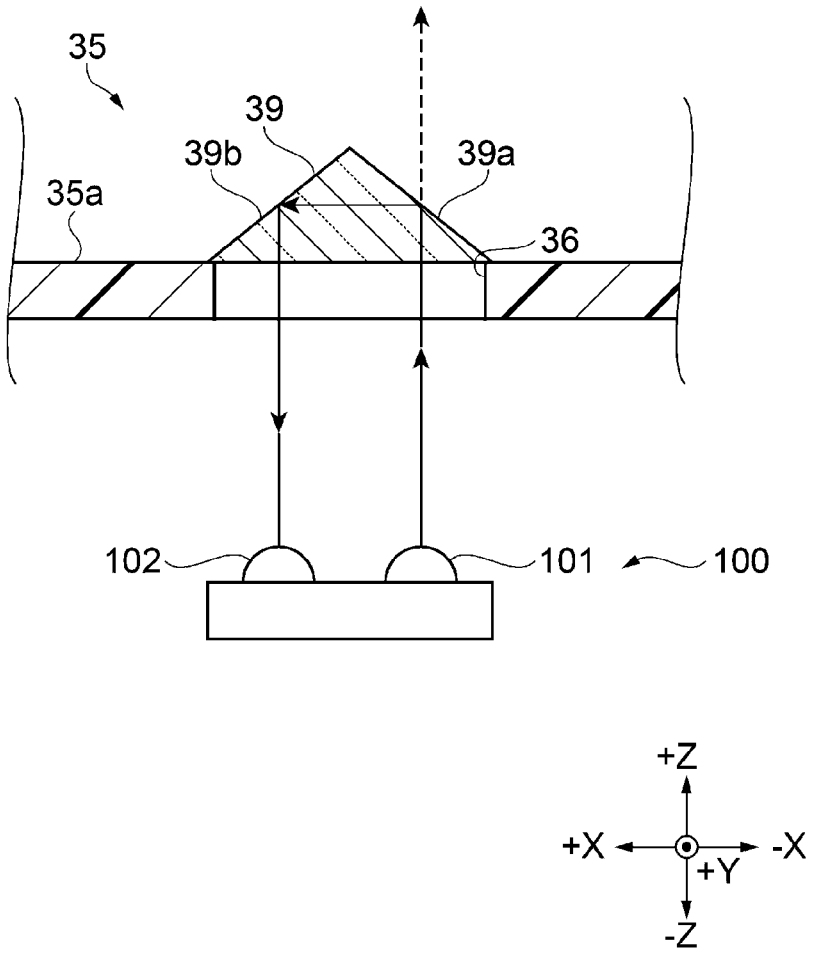
FIG. 8 is a diagram illustrating a method for detecting the remaining amount of ink according to the first embodiment.

Then, an internal configuration of the recording apparatus 1 will be described. FIG. 6 is a side view illustrating a partial configuration of the recording apparatus 1, and FIG. 7 is a side cross-sectional view illustrating a partial configuration of the recording apparatus 1. FIG. 8 is diagram illustrating a method for detecting the remaining amount of ink. As shown in FIGS. 3, 6, and 7, the recording apparatus 1 includes a carriage 30. The recording apparatus 1 includes a main scan feeding mechanism and a sub scan feeding mechanism for relatively moving the carriage 30 and the paper sheet P. The main scan feeding mechanism of the recording apparatus 1 includes a carriage motor and a drive belt 24. The carriage 30 is fixed to a part of the drive belt 24. Further, the carriage 30 is supported by a guide frame 28 which extends in the X axis. By transmitting the power of the carriage motor to the carriage 30 via the drive belt 24, the carriage 30 moves along the guide frame 28. As the carriage motor rotates forward and backward, the carriage 30 reciprocates along the main scan direction extending in the X axis, which is perpendicular to the transport direction of the paper sheet P. Further, the recording apparatus 1 includes an encoder for detecting a scan position in the X axis direction, which is a scan direction of the carriage 30. The speed and position of the carriage 30 are controlled in response to the pulse signal outputted from the encoder.

The sub scan feeding mechanism includes a transport motor, and a transport roller which is coupled to the transport motor and transports the paper sheet P. When the power of the transport motor is transmitted to the transport roller, the paper sheet P stacked in the paper sheet cassette 20 is transported toward the carriage 30 while being reversed, and further toward a platen 29. The paper sheet P on which recording is performed is outputted through the output port 18. The transport direction of the paper sheet P corresponds to the sub scan direction. The recording apparatus 1 includes a control unit. The carriage motor of the main scan feeding mechanism and the transport motor of the sub scan feeding mechanism operate according to the control signal from the control unit.

As shown in FIG. 6, a recording head 33 and an ink tank 35 are mounted on the carriage 30. The recording head 33 includes a nozzle plate 33*a* having a flat plate shape. The nozzle plate 33*a* is provided with a plurality of nozzles through which ink is ejected. The recording head 33 includes an actuator (not shown) corresponding to the respective nozzles, ink is ejected as liquid droplets through the nozzles by driving the actuator. The actuator may be, for example, a piezoelectric element. The platen 29 is disposed at a position facing the nozzle plate 33*a* of the recording head 33. The recording head 33 ejects ink onto the paper sheet P supported by the platen 29 to thereby perform printing onto the paper sheet P.

The ink tank 35 is a container that can store ink. In the present embodiment, a plurality of ink tanks 35 mounted on the carriage 30. As shown in FIG. 7, an inlet port 37 that communicates with the ink tank 35 is provided in the upper part of each ink tank 35. Ink in the ink tank 35 can be replenished via the inlet port 37. In the present embodiment, five ink tanks 35 are mounted on the carriage 30. The plurality of ink tanks 35, having substantially the same structure and shape, are arranged in the X axis direction. The ink tank 35 is made of a transparent resin material, which allows the inside of the ink tank 35 to be visible.

The present embodiment can adopt a configuration in which the plurality of ink tanks 35 store different types of ink or the same type of ink, or a configuration in which some of the plurality of ink tanks 35 store the same type of ink and the remaining ink tanks 35 store different types of ink. The type of ink may be, for example, the color of ink. The present embodiment can adopt a configuration in which the plurality of ink tanks 35 store different colors of ink or the plurality of ink tanks 35 store the same color of ink. The colors of ink may be, for example, black, yellow, magenta, cyan, and the like. Further, the types of ink may be dye ink, pigment ink, or the like.

Further, a cap member 50 for sealing the inlet port 37 is provided. The cap member 50 is provided for opening and closing the inlet port 37 of the ink tank 35. The cap member 50 includes a seal portion 51. The inlet port 37 is sealed by covering the inlet port 37 with the seal portion 51. The cap member 50 is individually provided for each of the plurality of ink tanks 35. As shown in FIG. 4, the user opens the cap member 50 corresponding to the ink tank 35 intended to be filled with ink so that the ink tank 35 is replenished with ink from the ink replenishing container 62.

As shown in FIGS. 7 and 8, a prism 39 for optically detecting the remaining amount of ink in the ink tank 35 is provided in the ink tank 35. The prism 39 is mounted on a bottom wall 35*a* of the ink tank 35. The prism 39 is provided inside the ink tank 35. The prism 39 is a transparent member, for example, made of a synthetic resin such as polypropylene.

Further, the recording apparatus 1 includes a sensor 100, which is located under the carriage 30, and includes a light-emitting portion 101 that emits light toward the prism 39 and a light-receiving portion 102 that receives light reflected by the prism 39. The sensor 100 is provided under the prism 39. A through hole 31 is provided in the vertical direction of the prism 39 of the carriage 30. The sensor 100 is disposed at a position facing the through hole 31 of the carriage 30, which scans along the X axis. That is, the sensor 100 is disposed at a position facing the prism 39 in the scan direction of the carriage 30. The light-emitting portion 101 is formed of an LED (light emitting diode), a laser light emitting element, or the like. Further, the light-receiving portion 102 is formed of a photo transistor, photo IC, or the like.

In the present embodiment, as shown in FIG. 7, the prism 39 is provided substantially in the vertical direction of the inlet port 37.

A method of detecting the remaining amount of ink in the ink tank 35 will now be described. As shown in FIG. 8, the prism 39 has a right triangle shape in sectional view. Among the faces of the prism 39, two inclined faces are referred to as reflecting surfaces 39*a* and 39*b*. The reflecting surfaces 39*a* and 39*b* are arranged to form a projection toward the inside of the ink tank 35. The reflecting surfaces 39*a* and 39*b* are configured to be directly in contact with ink in the ink tank 35. An opening 36 is formed at a position on the bottom wall 35*a* at which the prism 39 is located. Accordingly, the prism 39 can be directly seen from the outside. Further, as shown in FIG. 7, since the through hole 31 is provided in the carriage 30, the prism 39 can be directly seen from the outside through the through hole 31 while the ink tank 35 is mounted on the carriage 30.

The sensor 100 is coupled to the control unit. The control unit includes a CPU, a memory, and the like. The memory stores various programs executed by the CPU. These programs include an ink remaining amount detection control program for detecting the remaining amount of ink in the ink tank 35.

In the present embodiment, when the carriage 30 scans in the −X direction and the +X direction, the control unit causes the light-emitting portion 101 to emit light toward the prism 39, and, on the basis of the amount of reflected light received by the light-receiving portion 102 via the prism 39, determines whether the remaining amount of ink in the ink tank 35 is insufficient or not. That is, the control unit determines an ink-end on the basis of the amount of light received by the light-receiving portion 102. The ink-end refers to a state in which ink stored in the ink tank 35 becomes lower than the threshold.

The reflectance of light by the reflecting surfaces 39*a* and 39*b* of the prism 39 varies depending on the remaining amount of ink. For example, when ink is sufficiently stored in the ink tank 35, the emitted light is hardly reflected by the reflecting surface 39*a* and is almost absorbed in the ink due to a refractive index influenced by the reflecting surface 39*a* and the presence of ink in contact with the reflecting surface 39*a*. Accordingly, the amount of reflected light received by the light-receiving portion 102 via the reflecting surface 39*b* decreases, and thus an output signal of the light-receiving portion 102 becomes a relatively low-level signal. On the other hand, for example, when the remaining amount of ink in the ink tank 35 is small and thus ink is not in contact with the reflecting surface 39*a*, the amount of reflected light on the reflecting surface 39*a* increases. Accordingly, the amount of reflected light received by the light-receiving portion 102 via the reflecting surface 39*b* increases, and thus an output signal of the light-receiving portion 102 becomes a relatively high-level signal.

The control unit receives a level of the output signal of the light-receiving portion 102, and compares the level with a preset threshold. When the level of the output signal received from the light-receiving portion 102 is larger than the threshold, the control unit determines that the remaining amount of ink in the ink tank 35 is insufficient. That is, the control unit determines the ink-end. Further, when the control unit determines the ink-end, it causes the touch panel 23 to display a message indicating the ink-end. Thus, the user can recognize the ink-end.

Figure 9:
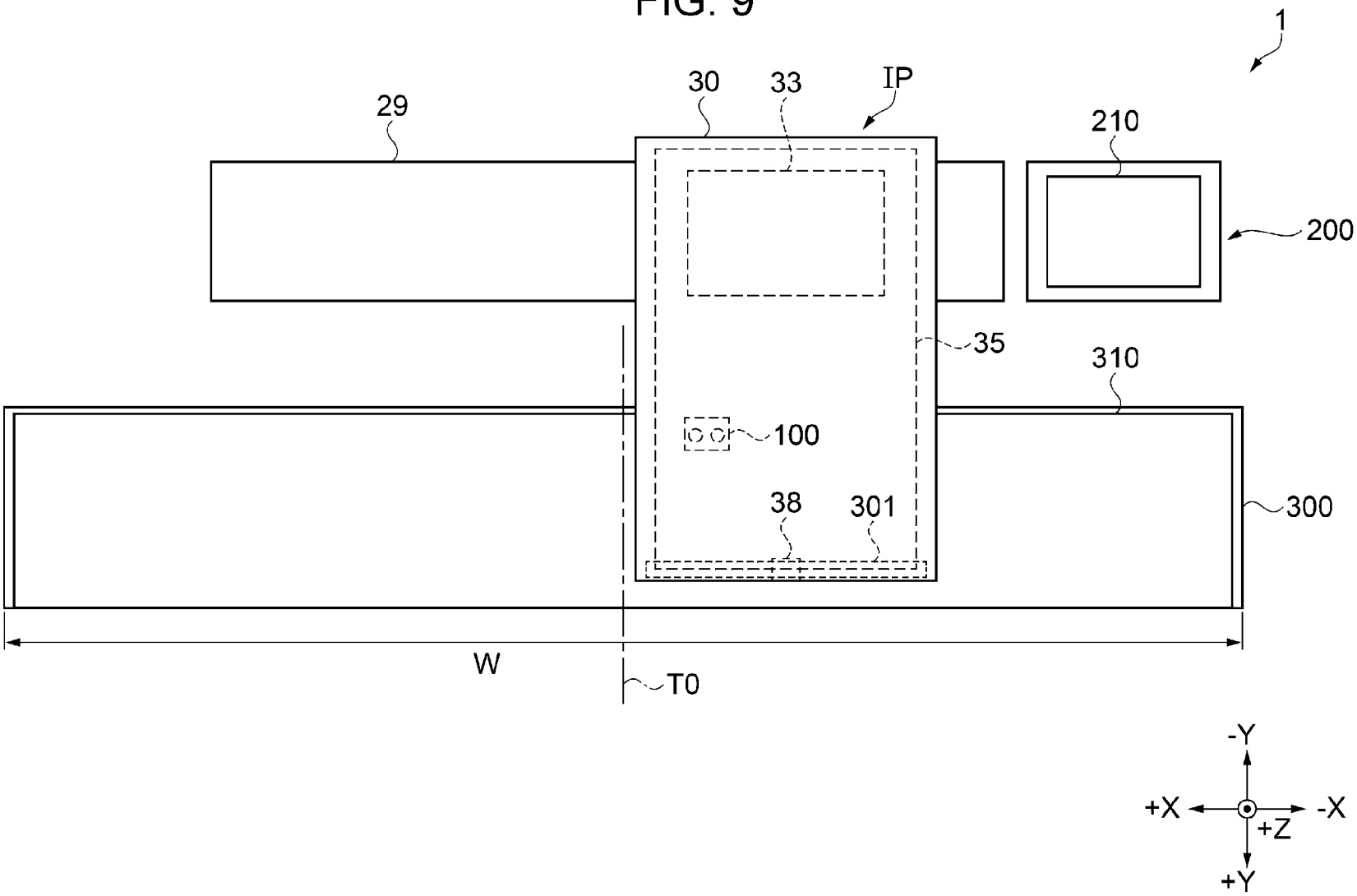
FIG. 9 is a diagram illustrating an arrangement position of a sensor according to the first embodiment.
Figure 10:
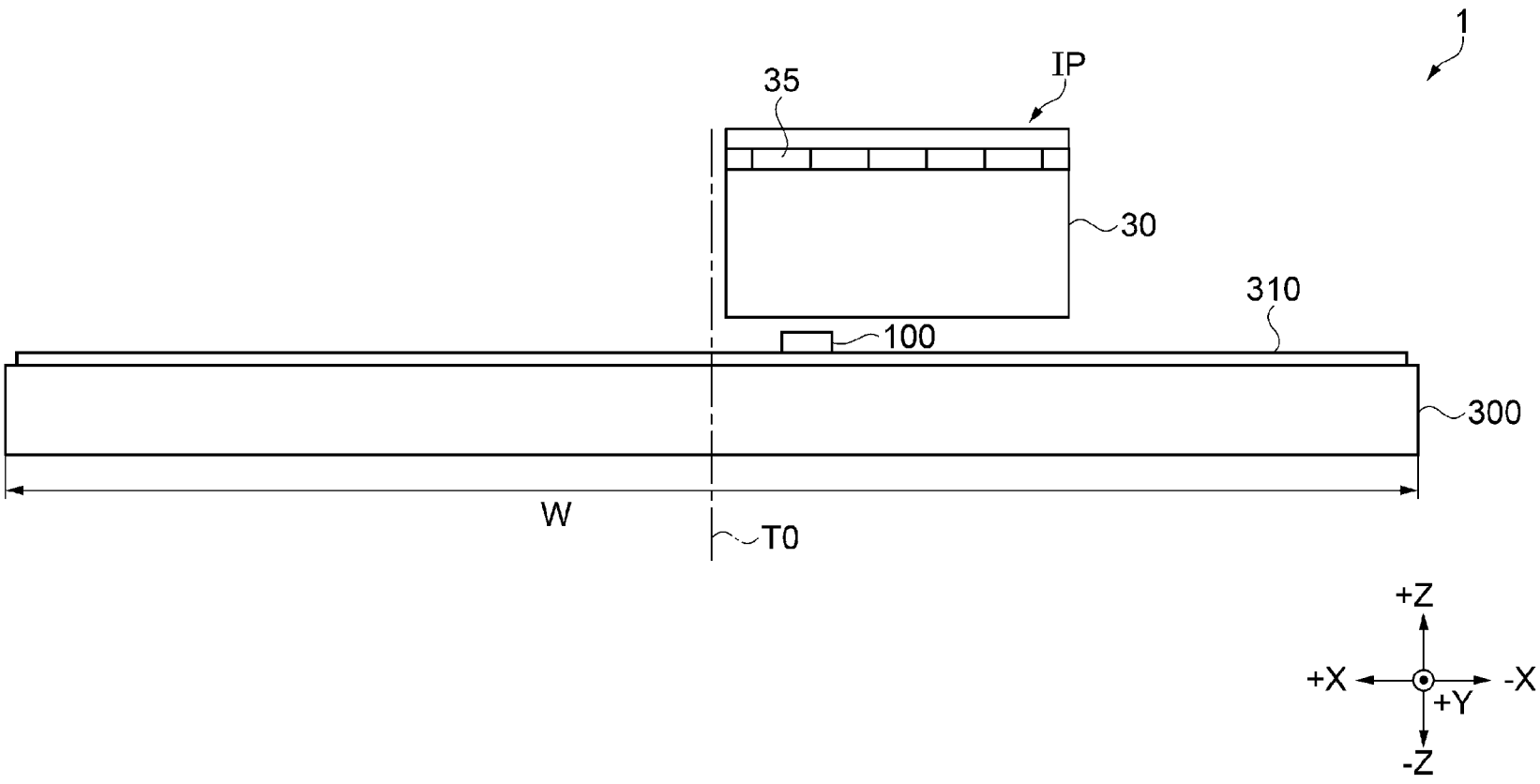
FIG. 10 is a diagram illustrating an arrangement position of a sensor according to the first embodiment.
Figure 11:
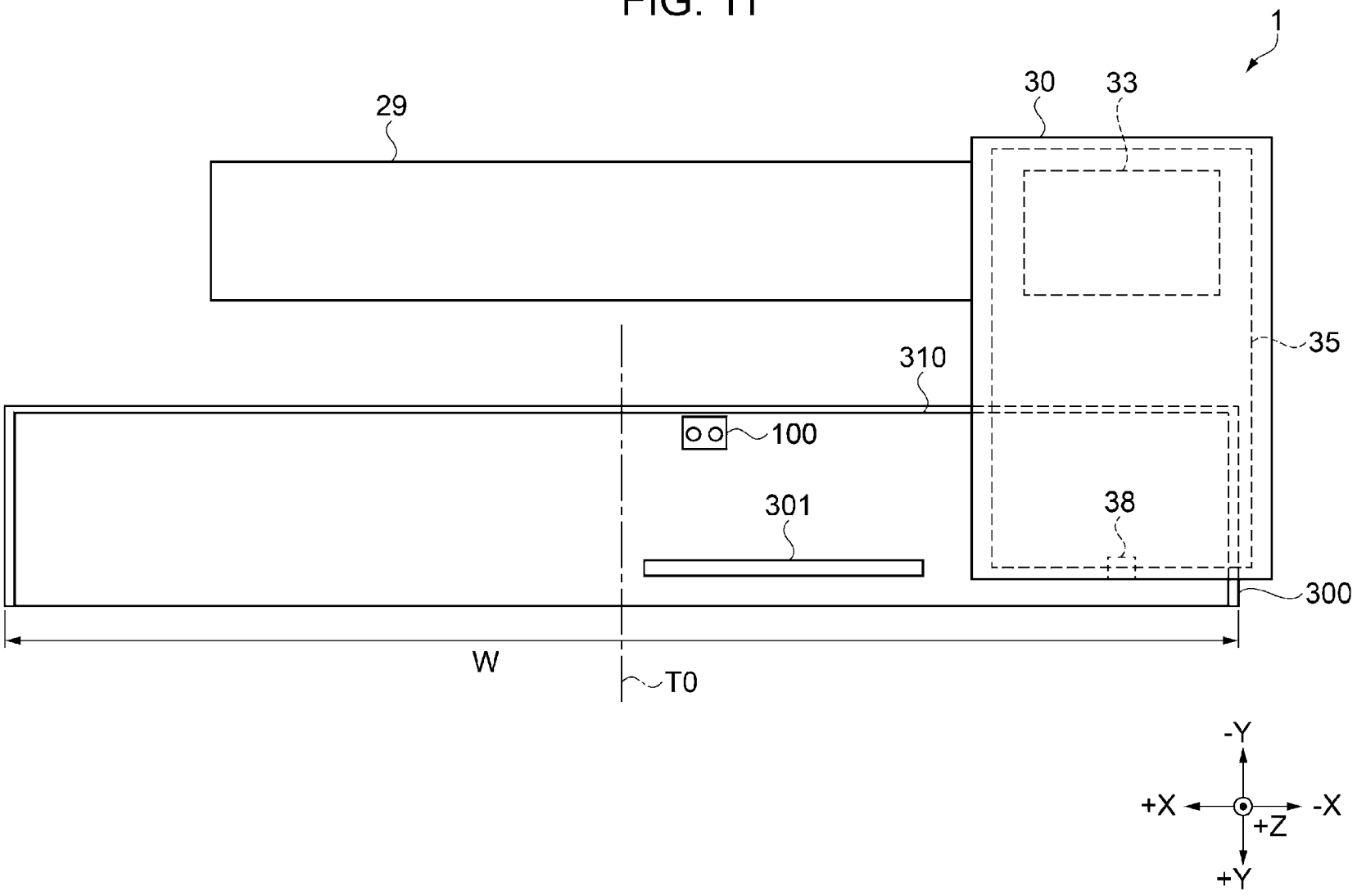
FIG. 11 is a plan view illustrating a configuration of a recording apparatus according to the first embodiment.

Next, a detailed installation position of the sensor 100 will be described. FIGS. 9 and 10 are diagrams illustrating an installation position of the sensor 100. Specifically, FIG. 9 is a schematic diagram illustrating the carriage 30 as viewed in the +Z direction when the carriage 30 is located at an ink replenishment position IP where ink in the ink tank 35 is replenished, and FIG. 10 is a schematic diagram illustrating the carriage 30 as viewed in the +Y direction when the carriage 30 is located at an ink replenishment position IP where ink in the ink tank 35 is replenished. FIG. 9 omits illustration of the housing 11 including the front panel 11*a*. Further, FIG. 10 omits illustration of the housing 11 including the front panel 11*a*, a protruding portion 38 and an abutting portion 301, described later. FIG. 11 is a plan view illustrating a configuration of the recording apparatus 1, in which the carriage 30 is located at a home position.

As shown in FIG. 9, the recording apparatus 1 includes a maintenance unit 200. The maintenance unit 200 performs various maintenance operations on the recording head 33. The maintenance unit 200 includes a cap 210. The cap 210 has a recess such that the cap 210 is in close contact with the nozzle plate 33*a* of the recording head 33 for capping when the recording apparatus 1 is not operating so as to prevent ink in the recording head 33 from drying to thereby prevent failures of the nozzles such as clogging. Further, flushing can also be performed so that the nozzles are always in good ejection state by ejecting ink from the nozzles while the nozzle plate 33*a* is capped by the cap 210. The maintenance unit 200 of the present embodiment is positioned on the −X direction side of the platen 29. The position where the maintenance unit 200 is disposed is a region where maintenance operation is performed on the recording head 33. In the recording apparatus 1 of the present embodiment, the position where the maintenance unit 200 is disposed is a standby position of the carriage 30 including the recording head 33. That is, the standby position of the carriage 30 is the home position.

As shown in FIGS. 9 and 10, a frame 300 extends in the main scan direction is disposed in the housing 11. The frame 300 extends in the housing 11 from the +X direction side to the −X direction side. The frame 300 has a plate shape. The frame 300 is disposed on the −Z direction side, which is a position under the carriage 30. The frame 300 is coupled to the front panel 11*a* as shown in FIG. 6 to ensure the rigidity of the front panel 11*a*. The sensor 100 is provided on the frame 300. Thus, the sensor 100 can be held in a stable state.

As shown in FIG. 9, when the carriage 30 is located at the ink replenishment position IP where ink in the ink tank 35 is replenished via the inlet port 37, the sensor 100 is disposed at a position hidden by the carriage 30 in plan view of the carriage 30 in the +Z direction, which is above the carriage 30. The ink replenishment position IP is a position predetermined for the case where the ink tank 35 is replenished with ink from the ink replenishing container 62 as shown in FIG. 4. The control unit drives the carriage motor on the basis of the input information from the touch panel 23 to thereby move the carriage 30 to the predetermined ink replenishment position IP. The ink replenishment position IP of the present embodiment is not the home position where the carriage 30 stands by at the position of the maintenance unit 200, but a position on the +X direction side of the home position. Since the ink replenishment position IP is provided at a position other than the home position, it is possible to avoid interference between the recording head 33 and the cap 210 when the ink replenishing container 62 is pressed downward against the ink tank 35 in replenishment of ink.

The sensor 100 is provided at a position deviated from the center of the frame 300 in the main scan direction. In the present embodiment, when the recording apparatus 1 is viewed in the +Z direction, the sensor 100 is provided at a position deviated in the −X direction from a center T0 of the width dimension W in the main scan direction of the frame 300, and between the center and the maintenance unit 200 in the main scan direction of the frame 300. Accordingly, since the sensor 100 is disposed at a position where an influence of warpage is smaller than the center of the frame 300, the function of the sensor 100 can be maintained. Further, since a distance from the home position to the ink replenishment position IP is relatively small, the sensor 100 can be moved from the home position to the ink replenishment position IP in a short time. Further, since the sensor 100 is less likely to be directly exposed to the external light when the top panel 12 is in the open state, the function of the sensor 100 can be maintained.

In addition, the position where the sensor 100 is disposed is a position corresponding to the region where the speed of the carriage 30 scanning in the main scan direction becomes constant. The speed control of the carriage 30 is different between the end regions and the center region of the platen 29 in the main scan direction. Specifically, the end region of the platen 29 in the main scan direction are acceleration/deceleration regions where the speed of the carriage 30 is accelerated or decelerated. On the other hand, the center region of the platen 29 between the end regions in the main scan direction is a constant speed region where the speed of the carriage 30 is constant.

In the acceleration/deceleration regions at the end regions, the amount of change in the liquid level due to ripple of ink in the ink tank 35 becomes large compared to that in the constant speed region at the center region. Since the sensor 100 is disposed at a position corresponding to the region where the speed of the carriage 30 is constant, detection is performed while the change in the liquid level due to ripple of ink in the ink tank 35 is relatively small. Accordingly, the detection accuracy of the remaining amount of ink can be increased.

As shown in FIGS. 7 and 10, the top of the sensor 100 is located above the top surface of the frame 300. Accordingly, for example, in replenishment of ink, even if the ink spilled from the replenishing container 62 runs along the frame 300 toward the sensor 100, ink is less likely to adhere to the sensor 100 since the top of the sensor 100 is located at a position higher than the top surface of the frame 300. Accordingly, the function of the sensor 100 can be maintained.

Further, as shown in FIGS. 6 and 11, the protruding portion 38 that protrudes toward the frame 300 is disposed in the lower part of the carriage 30. Specifically, the protruding portion 38 is disposed at the +Y direction end and the −Z direction end of the carriage 30. Further, the protruding portion 38 is disposed substantially at the center of the carriage 30 in the X axis direction. The protruding dimension of the protruding portion 38 is larger than the dimension of the sensor 100 protruding from the top surface of the frame 300. Further, the protruding portion 38 may also be each provided on both ends of the carriage 30 in the X axis direction.

In addition, the abutting portion 301 capable of abutting against the protruding portion 38 is provided at a position facing the protruding portion 38 of the frame 300. Specifically, a protective plate 310 is provided on the frame 300. The protective plate 310 has a thin plate shape, and is made of, for example, a metal material, and is disposed in the region of the frame 300 except for the region where the sensor 100 is positioned. Further, the top of the sensor 100 is located above the top surface of the protective plate 310. Since the protective plate 310 is provided, the frame 300 can be protected.

The abutting portion 301 protrudes above the protective plate 310 through an opening formed in the protective plate 310. The sum of the dimension of the protruding portion 38 in the Z axis direction and the dimension of the abutting portion 301 in the Z axis direction is larger than the dimension of the sensor 100 in the Z axis direction. In replenishment of ink, when the ink replenishing container 62 is engaged with the inlet port 37 of the ink tank 35, the carriage 30 is pressed in the gravity direction. That is, the carriage 30 is pressed in the direction of the frame 300. When the protruding portion 38 of the carriage 30 abuts the abutting portion 301, movement of the carriage 30 in the gravity direction is restricted. Accordingly, the sensor 100 provided under the carriage 30 can be reliably protected.

As shown in FIG. 4, the recording apparatus 1 includes the front panel 11*a* provided in front of the carriage 30. Further, a notch 17 is formed in the front panel 11*a* at a position corresponding to the carriage 30 when the carriage is located at the ink replenishment position IP so that the ink tank 35 is exposed through the notch 17. Specifically, the notch 17 is formed as a portion that is open downward from the top of the front panel 11*a*. The dimension of the notch 17 in the X axis direction is substantially the same as the width dimension of the carriage 30 in the X axis direction. Further, an opening 32 is formed in front of the carriage 30, which is on the +Y direction side. Thus, when the recording apparatus 1 is viewed in the +Y direction, a surface of the ink tank 35 on the +Y direction side can be seen. Accordingly, in replenishment of ink, ink in the ink tank 35 can be easily observed through the opening 32. Further, since the notch 17 is formed, the cap member 50 can be easily opened and closed.

According to the present embodiment, the following effects can be obtained.

In replenishment of ink in the ink tank 35, ink is replenished while the output port of the container such as the ink replenishing container 62 is engaged with the inlet port 37 of the ink tank 35. In so doing, for example, if the output port of the ink replenishing container 62 is misaligned with the inlet port 37 of the ink tank 35, or if the ink replenishing container 62 is unintentionally detached from the inlet port 37, ink is spilled from the ink replenishing container 62 and runs downward along the carriage 30. If the dripped ink adheres to the sensor 100, the function of the sensor 100 is reduced. Accordingly, in the present embodiment, the sensor 100 at the ink replenishment position IP is disposed at a position hidden by the carriage 30 in plan view. Therefore, even if ink is spilled from the ink replenishing container 62, the sensor 100 is protected by the carriage 30 to thereby prevent ink adhesion. Thus, the function of the sensor 100 can be maintained.

Ink replenishment in the present embodiment includes filling the empty ink tank 35 with ink at the time of setting up the recording apparatus 1, and refilling ink when the ink level in the ink tank reaches the lower limit where ink replenishment is required. Moreover, ink replenishment further includes adding ink to increase the amount of ink even if ink in the ink tank 35 is above the lower limit, and increasing the amount of ink to the upper limit or full level as well as increasing the amount of ink to the level lower than the upper limit or full level.

2. Second Embodiment

Figure 12:
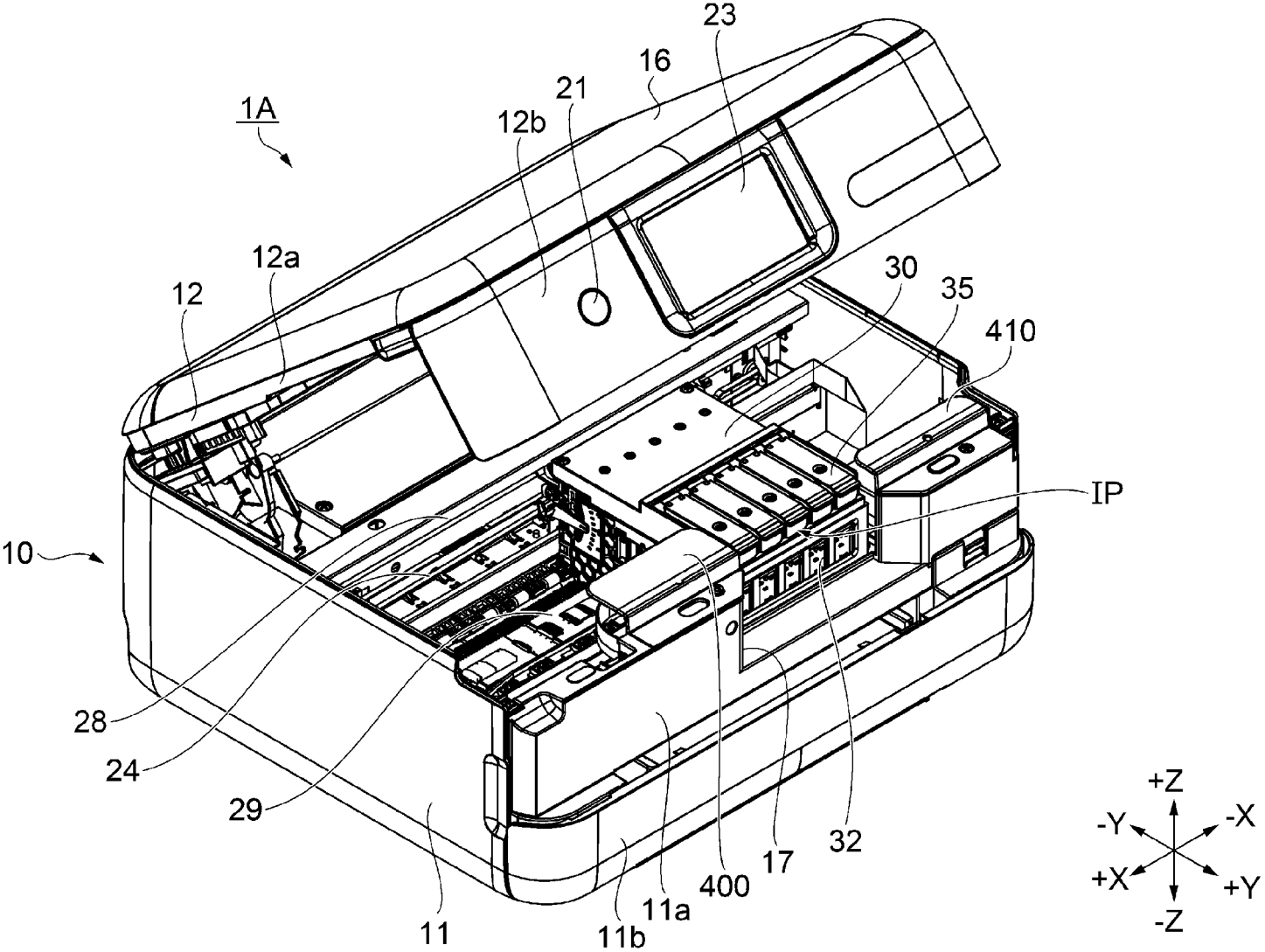
FIG. 12 is a perspective view illustrating a configuration of a recording apparatus according to a second embodiment.

The second embodiment will now be described. FIG. 12 is a perspective view illustrating a configuration of the recording apparatus 1A, FIG. 13 is a plan view illustrating a configuration of the recording apparatus 1A, and FIG. 14 is a side cross-sectional view illustrating part of the recording apparatus 1A.

Figure 13:
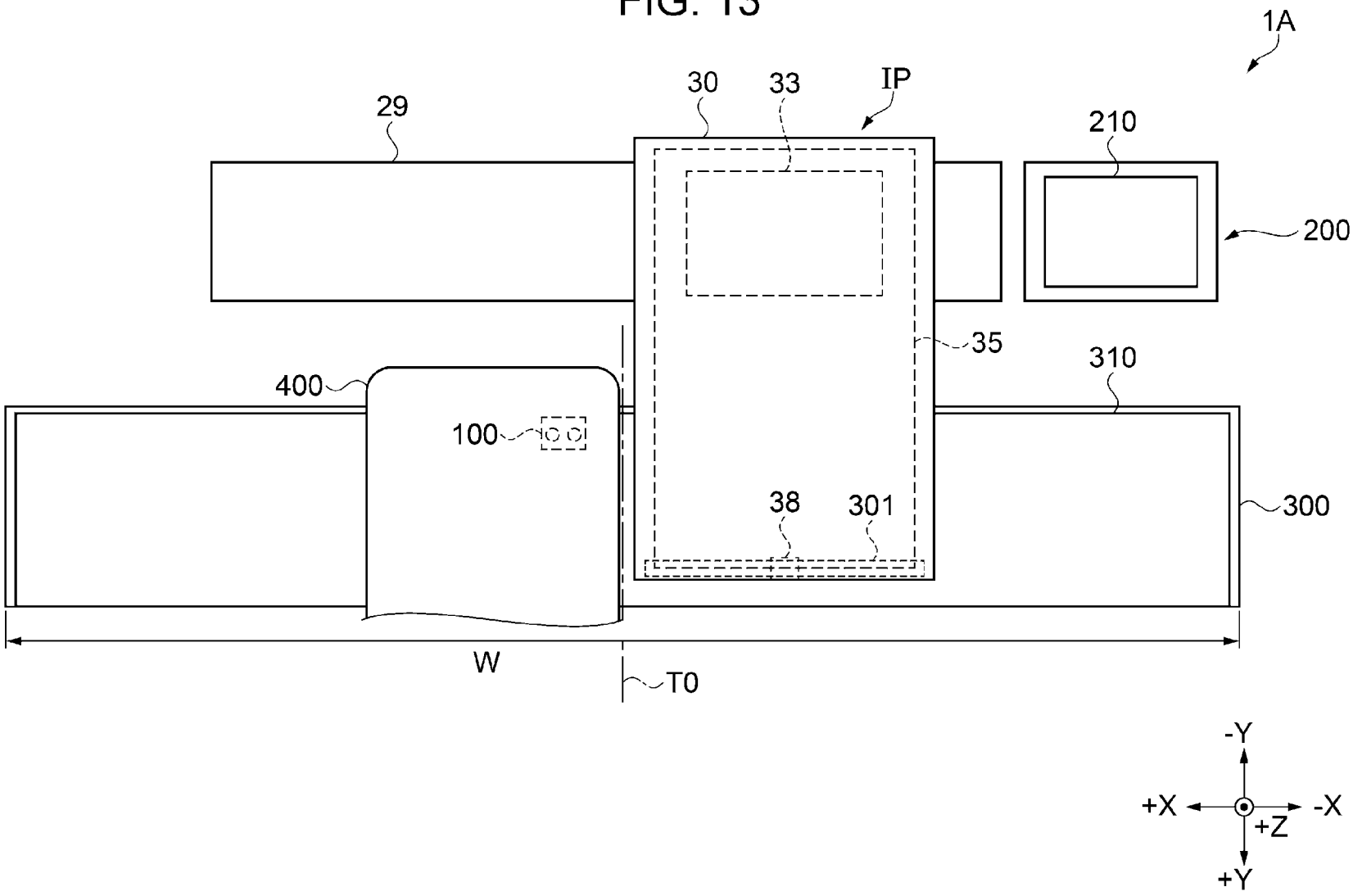
FIG. 13 is a plan view illustrating a configuration of a recording apparatus according to the second embodiment.
Figure 14:
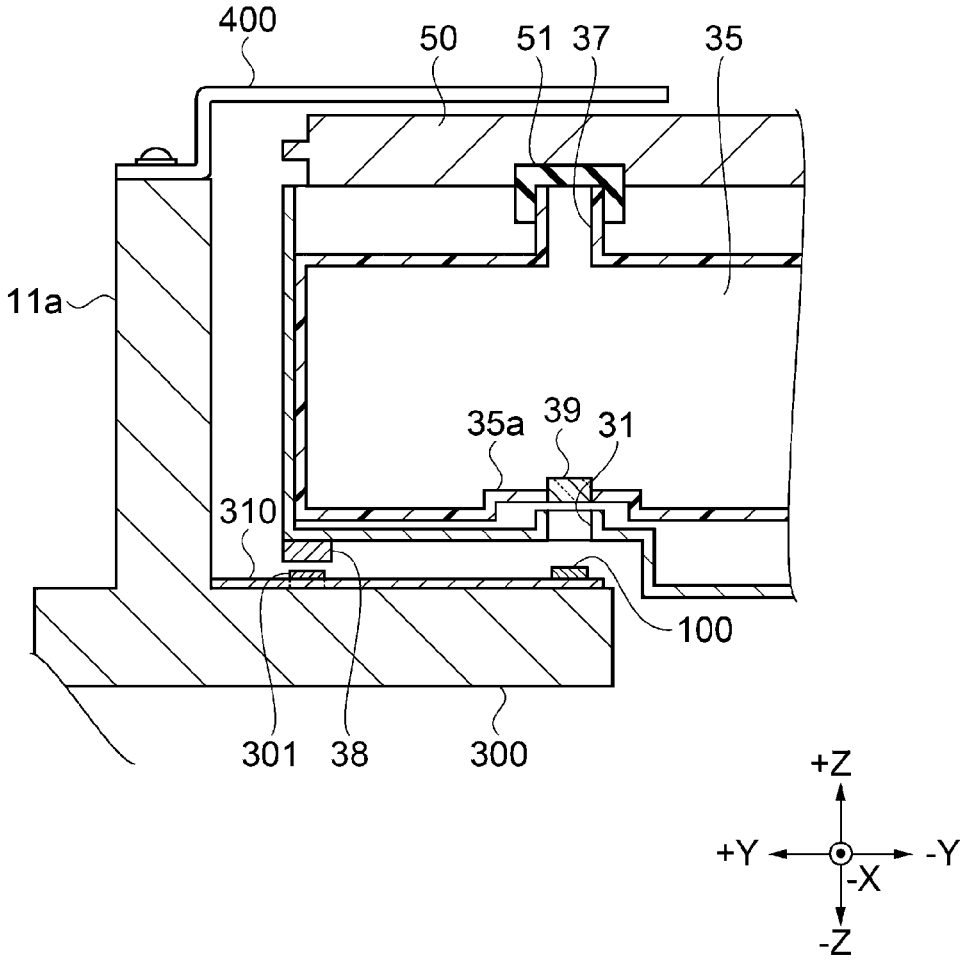
FIG. 14 is a side cross-sectional view illustrating a partial configuration of a recording apparatus according to the second embodiment.

As shown in FIGS. 12 to 14, the recording apparatus 1A includes the carriage 30 on which the recording head 33 and the ink tank 35 are mounted. The ink tank 35 has the inlet port 37 provided in the upper part of the ink tank 35 for replenishment of ink, and the prism 39 provided in the lower part of the ink tank 35, and the recording apparatus 1A includes the sensor 100 having the light-emitting portion 101 that emits light toward the prism 39 and the light-receiving portion 102 that receives light reflected by the prism 39. The sensor 100 is provided on the frame 300. An eaves 400 is provided above the sensor 100. In plan view of the eaves 400 as viewed from above the eaves 400, the sensor 100 is hidden by the eaves 400.

As shown in FIG. 13, in the present embodiment, when the carriage 30 is located at the ink replenishment position IP and the carriage 30 is viewed in the +Z direction, the sensor 100 is disposed at a position deviated from the carriage 30 in the +X direction. That is, the present embodiment differs from the configuration of the first embodiment in that the sensor 100 is disposed at a position that is not hidden by the carriage 30 in plan view when the carriage 30 is located at the ink replenishment position IP.

Therefore, in the present embodiment, the eaves 400 is provided above the sensor 100 to prevent ink adhesion to the sensor 100 due to running of ink or the like when ink in the ink tank 35 is replenished at the ink replenishment position IP. The eaves 400 has a plate shape. The +Y direction end of the eaves 400 is fixed to the top of the front panel 11*a* via a fixing member such as a screw. Further, the −Y direction end of the eaves 400 extends further in the −Y direction beyond the installation position of the sensor 100. The eaves 400 extends from the +X direction end of the notch 17 in the front panel 11*a* further in the +X direction beyond the installation position of the sensor 100.

As shown in FIG. 12, in addition to the eaves 400, another eaves 410 may also be provided. Another eaves 410 has the same configuration as the eaves 400, and is provided on the −X direction end of the notch 17 in the front panel 11*a*. Thus, in replenishment of ink, running of ink toward the frame 300 can be prevented.

According to the present embodiment, the following effects can be obtained.

The eaves 400 is provided above the sensor 100. Therefore, even if ink is spilled from the ink replenishing container 62, the sensor 100 is protected by the eaves 400 to thereby prevent ink adhesion. Thus, the function of the sensor 100 can be maintained. In the present embodiment, the configuration except for the installation position of the sensor 100 and the eaves 400 is the same as the configuration of the first embodiment, and the description thereof will be omitted.

3. Modified Examples

Modified examples will now be described.

Modified Example 1

The second panel section 12*b* may also be configured to include a tilt mechanism. That is, the second panel section 12*b* may be configured to be tiltable relative to the first panel section 12*a*. With this configuration, the remaining amount of ink in the ink tank 35 can be checked by tilting the second panel section 12*b* by the tilt mechanism even if the first panel section 12*a* is in the closed state.

Modified Example 2

A film having transparency to light that covers the light-emitting portion 101 and the light-receiving portion 102 of the sensor 100 may also be provided. The film can prevent adhesion of a foreign substance or the like to the light-emitting portion 101 and the light-receiving portion 102.

The following description will be given of the content derived from the embodiments.

A recording apparatus includes a carriage having a recording head that performs recording onto a transported medium and an ink tank that stores ink to be supplied to the recording head, which are mounted on the carriage, the carriage being configured to scan in a main scan direction, which is a direction intersecting a transport direction in which the medium is transported, wherein the ink tank has an inlet port provided in an upper part of the ink tank for replenishment of the ink, and a prism provided in a lower part of the ink tank, the recording apparatus includes a sensor located under the carriage and having a light-emitting portion that emits light toward the prism and a light-receiving portion that receives light reflected by the prism, and, when the carriage is located at an ink replenishment position where the ink in the ink tank is replenished via the inlet port, the sensor is disposed at a position hidden by the carriage in plan view of the carriage as viewed from above the carriage.

In replenishment of ink in the ink tank, ink is replenished while the output port of the replenishing container such as an ink bottle in which ink is stored is engaged with the inlet port of the ink tank. In so doing, for example, if the output port of the replenishing container is misaligned with the inlet port of the ink tank, or if the ink replenishing container is unintentionally detached from the inlet port, ink is spilled from the ink replenishing container and runs downward along the carriage. If the dripped ink adheres to the sensor, the function of the sensor is reduced. Accordingly, in the above configuration, the sensor at the ink replenishment position is disposed at a position hidden by the carriage in plan view. Therefore, even if ink is spilled from the replenishing container and runs downward along the carriage, the sensor is protected by the carriage serving as an eaves to thereby prevent ink adhesion. Thus, the function of the sensor can be maintained.

In the above recording apparatus, it is preferred that a frame extending in the main scan direction is provided at a position under the carriage, and the sensor is provided on the frame.

With this configuration, the sensor can be held in a stable state.

In the above recording apparatus, it is preferred that the sensor is provided at a position deviated from a center of the frame in the main scan direction.

With this configuration, since the sensor is disposed at a position where an influence of warpage is smaller than the center of the frame, the function of the sensor can be maintained.

In the above recording apparatus, it is preferred that the sensor is disposed at a position where a speed of the carriage scanning in the main scan direction is constant.

With this configuration, the amount of change in the liquid level due to ripple of ink in the ink tank is relatively small in the constant speed region. Since the sensor detection is performed while the carriage is in a constant speed, the detection accuracy can be improved.

In the above recording apparatus, it is preferred that a top of the sensor is located above a top surface of the frame.

With this configuration, since the top of the sensor is located at a position higher than the top surface of the frame, a foreign substance or ink is less likely to adhere to the sensor to thereby maintain the function of the sensor.

In the above recording apparatus, it is preferred that a protruding portion that protrudes toward the frame is disposed in a lower part of the carriage, and an abutting portion configured to abut against the protruding portion is provided at a position facing the protruding portion on the frame.

With this configuration, when a container such as an ink bottle in which ink is stored is mounted on the inlet port of the ink tank, the carriage is pressed in the gravity direction. That is, the carriage is pressed in the direction of the frame. When the protruding portion of the carriage abuts the abutting portion, movement of the carriage in the gravity direction is restricted. Accordingly, interference with the sensor provided at a position under the carriage is reduced.

In the above recording apparatus, it is preferred that a front panel is provided in front of the carriage, and a notch is formed in the front panel at a position corresponding to the carriage when the carriage is located at the ink replenishment position so that the ink tank is exposed through the notch.

With this configuration, the state of the ink tank being filled with ink can be easily observed in replenishment of ink.

A recording apparatus includes a carriage having a recording head that performs recording onto a transported medium and an ink tank that stores ink to be supplied to the recording head, which are mounted on the carriage, the carriage being configured to scan in a main scan direction, which is a direction intersecting a transport direction in which the medium is transported, wherein the ink tank has an inlet port provided in an upper part of the ink tank for replenishment of the ink, and a prism provided in a lower part of the ink tank, the recording apparatus includes a sensor located under the carriage and having a light-emitting portion that emits light toward the prism and a light-receiving portion that receives light reflected by the prism, and an eaves is provided above the sensor such that the sensor is hidden by the eaves when the eaves is viewed in plan view from above the eaves.

In replenishment of ink in the ink tank, ink is replenished while the output port of the replenishing container such as an ink bottle in which ink is stored is engaged with the inlet port of the ink tank. In so doing, for example, if the output port of the replenishing container is misaligned with the inlet port of the ink tank, or if the ink replenishing container is unintentionally detached from the inlet port, ink is spilled from the ink replenishing container. Then, if the spilled ink adheres to the sensor, the function of the sensor is reduced. In the above configuration, the eaves is provided above the sensor. Therefore, even if ink is spilled from the ink replenishing container, the sensor is protected by the eaves to thereby prevent ink adhesion. Thus, the function of the sensor can be maintained.

What is claimed is:

1. A recording apparatus comprising a carriage having a recording head that performs recording onto a medium supported by a platen and an ink tank that stores ink to be supplied to the recording head, which are mounted on the carriage, the carriage being configured to scan in a main scan direction, which is a direction intersecting a transport direction in which the medium is transported, wherein the ink tank has an inlet port provided in an upper part of the ink tank for replenishment of the ink, and a prism provided in a lower part of the ink tank, the recording apparatus includes a sensor located under the carriage and having a light-emitting portion that emits light toward the prism and a light-receiving portion that receives light reflected by the prism, the carriage is located at a standby position when a maintenance operation is performed on the recording head, the carriage is located at an ink replenishment position, which is not the standby position, when the ink is replenished via the inlet port, when the carriage is located at the ink replenishment position, the sensor is disposed at a position hidden by the carriage in plan view of the carriage as viewed from above the carriage, and the ink replenishment position overlaps with the platen in plan view as viewed from above the carriage.

2. The recording apparatus according to claim 1, wherein a frame extending in the main scan direction is provided at a position under the carriage, and the sensor is provided on the frame.

3. The recording apparatus according to claim 2, wherein the sensor is provided at a position deviated from a center of the frame in the main scan direction.

4. The recording apparatus according to claim 2, wherein the sensor is disposed at a position where a speed of the carriage scanning in the main scan direction is constant.

5. The recording apparatus according to claim 4, wherein the sensor is disposed at a position where a speed of the carriage to print on a media is constant.

6. The recording apparatus according to claim 2, wherein a top of the sensor is located above a top surface of the frame.

7. The recording apparatus according to claim 2, wherein
a protruding portion that protrudes toward the frame is disposed in a lower part of the carriage, and
an abutting portion configured to abut against the protruding portion is provided at a position facing the protruding portion on the frame.

8. The recording apparatus according to claim 7, wherein
a first protruding dimension of the protruding portion from the carriage is larger than a second protruding dimension of the sensor from a top surface of the frame.

9. The recording apparatus according to claim 1, wherein
a front panel is provided in front of the carriage, and
a notch is formed in the front panel at a position corresponding to the carriage when the carriage is located at the ink replenishment position so that the ink tank is exposed through the notch.

10. The recording apparatus according to claim 1, wherein a top of the light-emitting portion and the light-receiving portion is located above a top surface of the frame.

11. A recording apparatus comprising:
a carriage having a recording head that performs recording onto a transported medium and an ink tank that stores ink to be supplied to the recording head, which are mounted on the carriage, the carriage being configured to scan in a main scan direction, which is a direction intersecting a transport direction in which the medium is transported, wherein
the ink tank has an inlet port provided in an upper part of the ink tank for replenishment of the ink, and a prism provided in a lower part of the ink tank,
the recording apparatus includes a sensor located under the carriage and having a light-emitting portion that emits light toward the prism and a light-receiving portion that receives light reflected by the prism,
the carriage is located at a standby position when a maintenance operation is performed on the recording head,
the carriage is located at an ink replenishment position, which does not overlap with the standby position in plan view as viewed from above the carriage, when the ink is replenished via the inlet port, and
when the carriage is located at the ink replenishment position, the sensor is disposed at a position hidden by the carriage in plan view of the carriage as viewed from above the carriage.

12. The recording apparatus according to claim 11, wherein
a frame extending in the main scan direction is provided at a position under the carriage, and
the sensor is provided on the frame.

13. The recording apparatus according to claim 11, wherein the sensor is provided at a position deviated from a center of the frame in the main scan direction.

14. The recording apparatus according to claim 11, wherein the sensor is disposed at a position where a speed of the carriage scanning in the main scan direction is constant.

15. The recording apparatus according to claim 11, wherein
a protruding portion that protrudes toward the frame is disposed in a lower part of the carriage, and
an abutting portion configured to abut against the protruding portion is provided at a position facing the protruding portion on the frame.

16. The recording apparatus according to claim 11, wherein
a front panel is provided in front of the carriage, and
a notch is formed in the front panel at a position corresponding to the carriage when the carriage is located at the ink replenishment position so that the ink tank is exposed through the notch.

17. The recording apparatus according to claim 11, wherein
a first protruding dimension of the protruding portion from the carriage is larger than a second protruding dimension of the sensor from a top surface of the frame.

18. The recording apparatus according to claim 11, wherein
the sensor is disposed at a position where a speed of the carriage to print on a media is constant.

* * * * *